United States Patent [19]

Jackson

[11] Patent Number: 4,630,524

[45] Date of Patent: Dec. 23, 1986

[54] CONTROL VALVE FOR PILE DRIVER AND METHOD

[75] Inventor: E. Don Jackson, Jackson County, Mo.

[73] Assignee: Conmaco, Inc., Kansas City, Kans.

[21] Appl. No.: 639,701

[22] Filed: Aug. 13, 1984

[51] Int. Cl.[4] ..... F01L 31/00

[52] U.S. Cl. ..... 91/219; 91/218

[58] Field of Search ..... 91/400, 392, 393, 397, 91/398, 218, 219, 382, 350, 352, 354; 137/625.21, 625.22

[56] References Cited

U.S. PATENT DOCUMENTS

| | | | |
|---|---|---|---|
| 378,745 | 2/1888 | Warrington | 91/218 |
| 2,247,802 | 7/1941 | Damerell | 91/218 X |
| 2,728,193 | 12/1955 | Bacchi | 91/400 X |
| 3,479,924 | 11/1969 | Ferguson | 91/392 X |
| 4,530,645 | 7/1985 | Whatley et al. | 91/275 |

*Primary Examiner*—Edward K. Look

*Attorney, Agent, or Firm*—Kokjer, Kircher, Bradley, Wharton, Bowman & Johnson

[57] ABSTRACT

A power driver and method of pile driving. The invention encompasses a pile driver having a ram, cylinder and piston arrangement mounted in a framework, such arrangement being typical of those power drivers of the prior art. A compressible fluid, such as air or steam, enters into the cylinder through an intake port and leaves through an exhaust port. Both ports are controlled by a common valve. Expansion of the steam within the cylinder acts against the piston causing the piston rod to rise thus raising the ram and an associated slide bar. As the slide bar rises, it triggers the valve to move into a position effecting closure of both intake and exhaust ports. Further rising of the piston effects movement of the valve into a position wherein the intake port remains closed and the exhaust port is opened, thus exhausting the excess steam. Movement of the valve by elevation of the slide bar at each stage of movement is effected through triggering of cam followers or trips by cams on the slide bar. At the end of the power stroke, the valve is returned to the first position which opens the intake port and closes the exhaust port and the steps are repeated. Thus, during a significant portion of the total distance of travel of the piston, fluid is neither entering nor leaving the cylinder but is expanding and performing work on the piston, thereby providing an energy savings in operation of the driver of ten to fifty percent over devices of the prior art.

6 Claims, 8 Drawing Figures

CONTROL VALVE FOR PILE DRIVER AND METHOD

This invention relates generally to power drivers and, more particularly, to an energy saving device for fluid driven pile drivers.

Steam or pneumatic hammers have long been the primary means of driving structural columns of timber, concrete or steel into the ground. A general operating principal of pile drivers is to utilize a compressed fluid to raise the hammer head of the pile driver to an elevated position from which it is allowed to drop under the influence of gravity to exert a driving force on the structural member. Heretofore, the cylinder which confines the driving fluid to allow it to expand and raise the hammer head is provided with intake and exhaust ports for controlling the flow of the compressed fluid. It has been the practice, in most constructions, to close the exhaust port while the intake port receives the compressed operating fluid. Enough fluid is introduced into the closed cylinder during approximately the first one-half of the stroke of the piston to carry the piston to the end of its stroke under the influence of piston momentum and the force of expanding fluid which starts to exhaust as soon as the intake port is closed. Thus, in the foregoing described prior art constructions, the cylinders of the pile hammers have heretofore had only two operating conditions, fluid in and fluid out.

The present invention provides a substantial improvement in the energy efficiency of a pile hammer by including a third operating position for the power cylinder, namely an expansion position wherein the operating fluid is trapped in the cylinder and allowed to expand before it is exhausted. It has been found that this results in significant energy savings in the order of magnitude of 10–50 percent.

It is, therefore, a primary object of the present invention to provide a method and device for a power driver such as a pile hammer wherein the energy required to move the hammer is substantially reduced by utilizing an expansion stroke for the drive cylinder prior to exhausting the drive fluid from the cylinder.

A primary objective of the invention is to provide a method and device as set forth in the foregoing object wherein the energy savings are accomplished without the need for significant capital expenditures for modifications in existing designs.

Another very important aim of my invention is to provide a method and device as set forth in the preceding objects wherein the device and method can be employed on existing pile hammers with only minor modifications in the equipment.

Other objects of the invention will be made clear or become apparent from the following description and claims when read in light of the accompanying drawing wherein:

Figure 1:
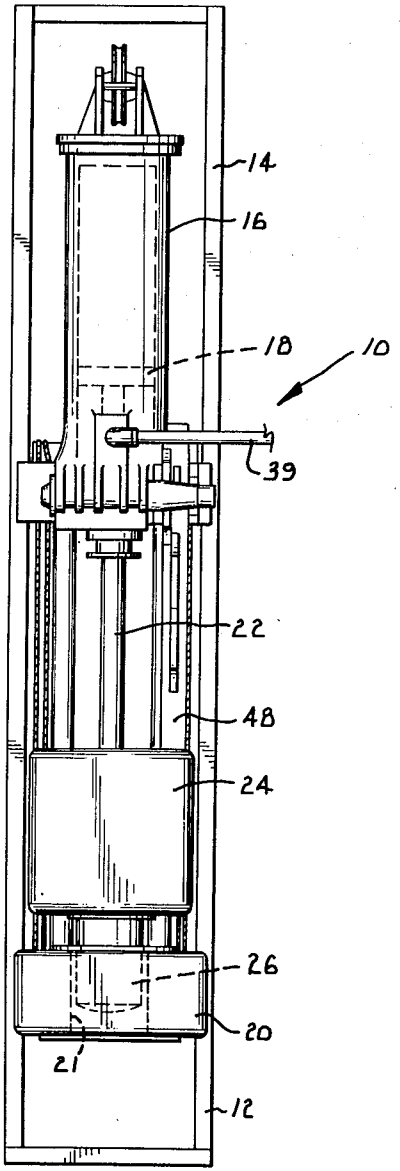
FIG. 1 is a front elevational view of a pile hammer constructed according to the present invention.

Referring initially to FIG. 1, the pile driver or hammer is designated generally by the numeral 10. Hammer 10 includes a framework 12 which holds the rest of the structure. Framework 12 includes a vertical section 14 which guides cylinder 16, piston 18 and the base 20. A piston rod 22 extending from cylinder 16 supports a ram 24. Ram point 26, which is an integral part of ram 24, extends through an opening 21 in base 20 and serves as the drive head for moving the pile. It is to be understood that all of the foregoing components are found on a conventional pile hammer and are well known to those skilled in the art. Accordingly, further details of construction of the pile hammer have not been illustrated herein in the interest of brevity.

Figure 2:
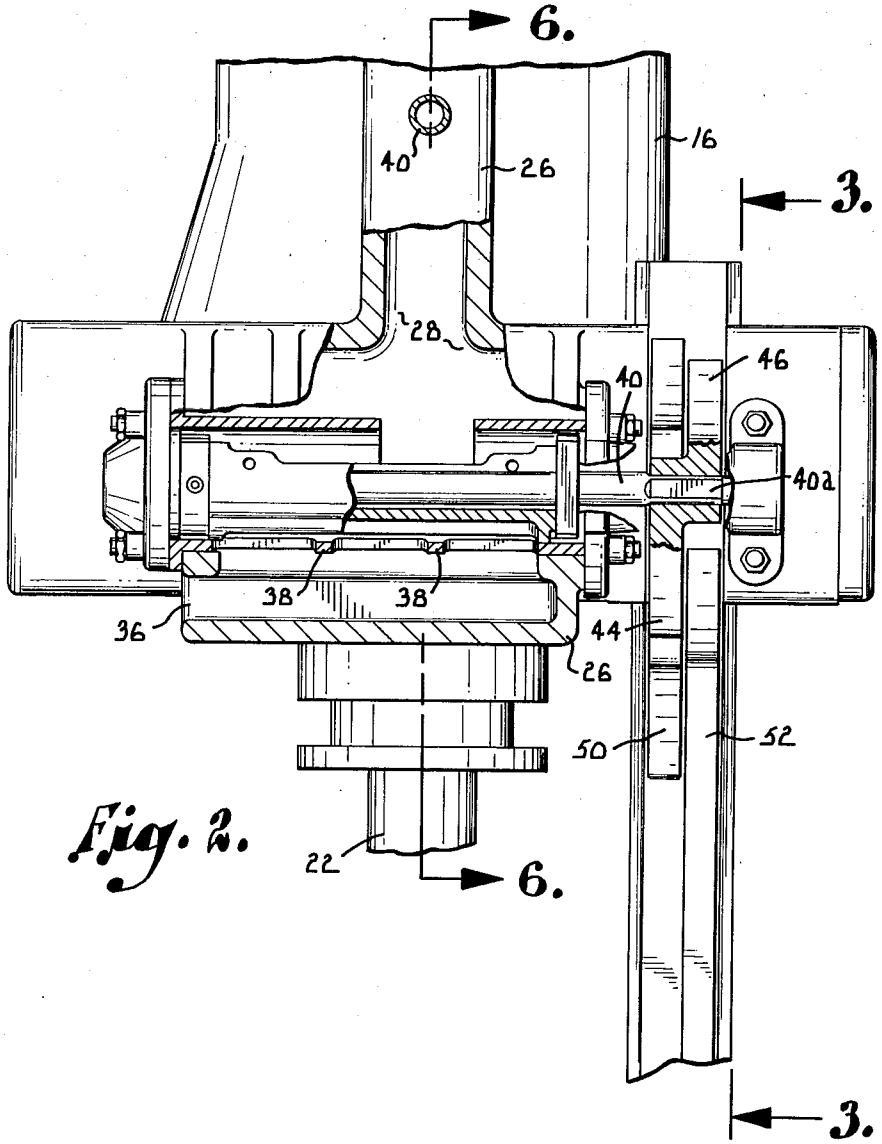
FIG. 2 is a greatly enlarged vertical cross-sectional view showing details of construction of the control valve for the power cylinder.
Figure 6:
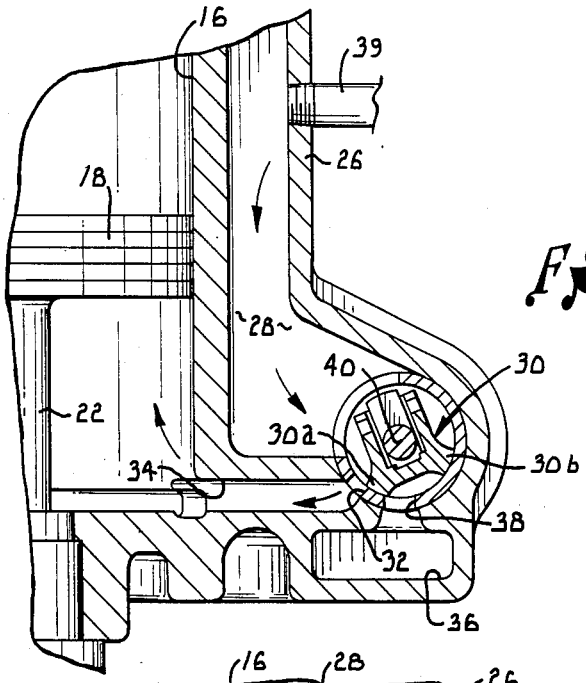
FIG. 6 is a vertical cross-sectional view taken along line 6—6 of FIG. 2 showing further details of construction of the control valve.

Referring now to FIGS. 2 and 6, a housing 29 is mounted on the outside wall of cylinder 16 and presents an enclosed passageway 28 that is in communication with the interior of cylinder 16 through valve 30, intake port 32 and cylinder inlet passage 34. Housing 29 also defines an exhaust passage 36 that is in communication with the interior of cylinder 16 through valve 30 and exhaust port 38. A compressed operating fluid is introduced into passageway 28 via input line 39.

Figure 3:
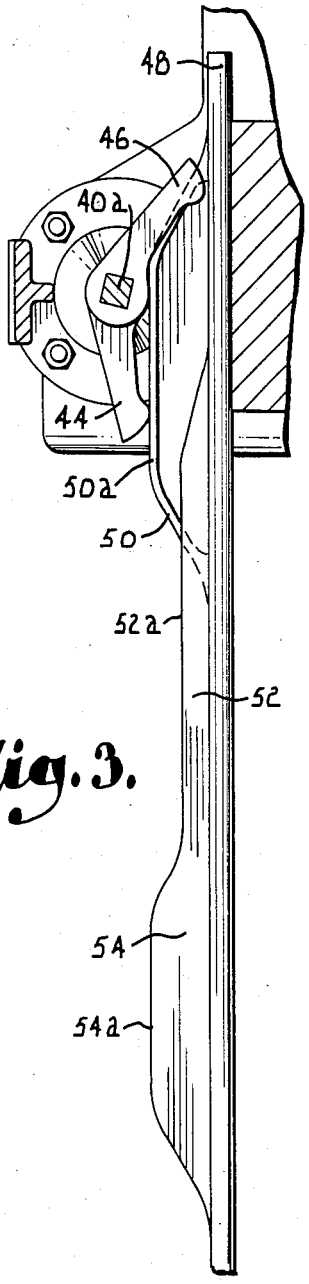
FIG. 3 is an enlarged vertical cross-sectional view taken along line 3—3 of FIG. 2.
Figure 4:
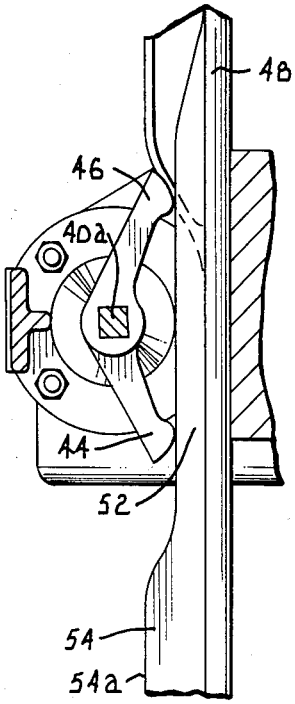
FIG. 4 is another vertical cross-sectional view similar to FIG. 3 with the valve trips moved to different positions.
Figure 5:
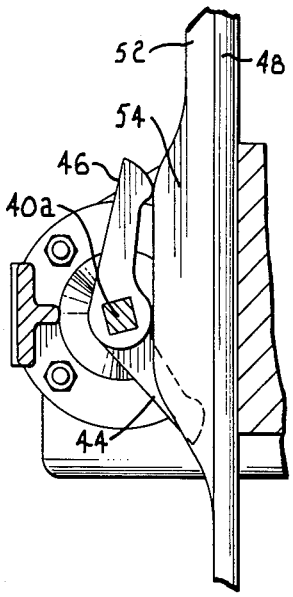
FIG. 5 is a vertical cross-sectional view similar to FIGS. 3 and 4 and illustrating another position for both of the valve trips.

Valve 30 presents an inverted Y with first and second legs 30*a* and 30*b*. The valve body is keyed to a shaft 40 which serves as the valve stem and an integral valve stem extension 40*a* mounts first and second trip arms 44 and 46 which are keyed to the extension 40*a* in the manner illustrated in FIGS. 3–5. As indicated in FIG. 2, trips 44 and 46 are also integral one with the other. All of the foregoing structure is also known in the prior art.

Rigid with falling weight 24 is a slide bar 48 which is mounted for rectilinear movement along a path parallel to the path of piston rod 22. Slide bar 48 is provided with a first cam 50 having an elongated camming surface 50*a*, a second cam 52 having an elongated camming surface 52*a*, and a third cam 54 having an elongated camming surface 54*a*. As best understood from viewing FIG. 2, first cam 50 is disposed in planar alignment with first valve trip 44 while the second and third cams 52 and 54 which are in alignment with one another are also aligned with second valve trip 46.

Figure 7:
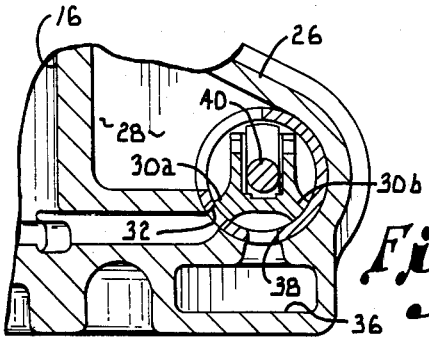
FIG. 7 is a vertical cross-sectional view similar to FIG. 6 showing an alternate position for the valve.

In operation, the framework 12 would be positioned so that hammer 10, and in particular the ram point 26, is in alignment with a pile to be driven into the ground. The hammer may be powered by any compressible fluid such as air or steam. For purposes of discussion, it will be assumed that steam enters passageway 28 through line 39 and continues on into cylinder 16 via intake port 32 as the valve is in the position shown in FIG. 6. Valve 30 is held in the open position until the second valve trip 46 contacts the leading edge of camming surface 52*a* as a result of steam pressure within the cylinder acting against piston 18 and causing the piston and piston rod 22 to rise carrying with it ram 24, ram point 26 and slide bar 48. As the slide bar moves upwardly and camming surface 52*a* engages second valve trip 46 to move it into the position shown in FIG. 4, valve 30 will move into the position shown in FIG. 7 where both exhaust port 38 and intake port 32 are closed.

Figure 8:
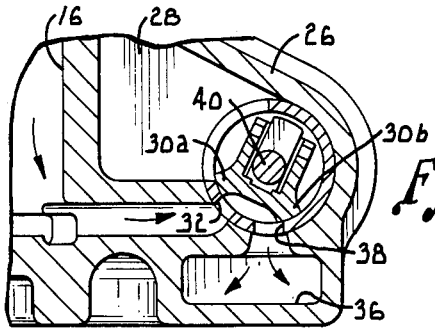
FIG. 8 is another vertical cross-sectional view showing a third position for the control valve.

As trip arms 44 and 46 travel along camming surface 52*a*, the steam within cylinder 16 will expand acting against piston 18 and continue to raise the falling weight, piston 18, rod 22, ram 24 and ram point 26. As the piston approaches the end of its power stroke, second valve trip 46 will engage the third camming surface 54*a* thereby moving valve 30 to the position illustrated in FIG. 8 wherein the intake port is closed to incoming steam and the exhaust port is open. As the exhaust port is open, piston 18 will move downwardly in the cylinder under its own weight and the substantial additional force of the falling weight. Ram point 26 will engage the pile to force it into the ground. As the piston 18 approaches the end of its exhaust stroke, slide bar 48 will move downwardly causing camming surface 50*a* to again engage first valve trip 44 thereby moving valve 30 back to its initial position as shown in FIG. 6. In this position, the intake port is again open for steam to enter the cylinder to commence the power stroke while the exhaust port is closed to steam exiting from the cylinder. The process is repeated during the entire pile driving operation.

The key to the present invention is the utilization of second cam 52 to hold valve 30 in a position where steam is neither entering nor leaving cylinder 16 over a significant portion of the total distance of travel of piston 18. Thus, during this time, steam in the cylinder is expanding and performing work on piston 18 for maximum operating efficiency. This is to be contrasted with prior devices wherein valve 30 was movable between only two positions, namely intake and exhaust. This required that excess steam be delivered to cylinder 16 so as to provide sufficient power for piston 18 to continue its upward travel, partially relying on momentum, while valve 30 assumed its alternate position wherein steam was exhausted from the cylinder.

By utilizing the device of the present invention, a method of operating a power driver has been achieved wherein savings of ten to fifty percent on energy costs are realized when compared with prior art devices.

I claim:

1. In a power driver having a drive head, a cylinder, and a piston, said piston being coupled with said drive head and said cylinder having an intake port and an exhaust port, said cylinder being adapted to be coupled with a source of compressible fluid, and further including a valve for controlling the flow of said fluid to and from said cylinder, the improvement comprising the combination of:

a first valve trip coupled with said valve;

a second valve trip coupled with said valve;

a slide bar movable along a rectilinear path in response to movement of said piston;

first camming means on said slide bar for moving said first valve trip to a first position wherein said intake port is open and said exhaust port is closed, whereby said fluid enters said cylinder under compression;

second camming means on said slide bar for moving said second valve trip to a first position wherein said valve blocks passage of said fluid to said cylinder will also preventing escape of said fluid from said cylinder, said second camming means maintaining said second valve trip in said first position for a sufficient length of time to allow the expansion of the fluid to move the piston along a significant portion of its travel distance; and third camming means on said slide bar for moving said second valve trip to a second position wherein said intake port and said exhaust port are in communication whereby said fluid is exhausted from said cylinder.

2. A device of the type set forth in claim 1, wherein said first camming means extends over a distance sufficient to allow a quantity of said fluid to enter said cylinder such that upon expansion said fluid will move said piston to the end of its power stroke.

3. A device of the type set forth in claim 2, wherein said first camming means engages said first valve trip as said piston approaches the end of its exhaust stroke.

4. A device of the type set forth in claim 3, wherein said second camming means maintains said second valve trip in said first position while said piston moves approximately one third of the distance to the end of its power stroke.

5. A pile hammer comprising:

a framework;

a cylinder mounted on said framework and adapted to be coupled with a source of compressible fluid, said cylinder having an intake port and an exhaust port;

valve means for controlling the flow of said fluid to and from said cylinder;

a piston disposed in said cylinder and having a piston rod extending from the cylinder;

a ram coupled with said piston rod;

a first valve trip coupled with said valve means;

a second valve trip coupled with said valve means;

a slide bar coupled with said ram and movable along a rectilinear path in response to movement of said piston;

a first cam surface on said slide bar for moving said first valve trip to a first position wherein said intake port is open and said exhaust port is closed, whereby said fluid enters said cylinder under compression;

a second cam surface on said slide bar for moving said second valve trip to a first position wherein said valve blocks passage of said fluid to said cylinder while also preventing escape of said fluid from said cylinder whereby expansion of fluid in said cylinder is accommodated; and a third cam surface on said slide bar for moving said second valve trip to a second position wherein said intake port and said exhaust port are in communication whereby said fluid is exhausted from said cylinder.

6. A method of moving a power driver wherein the driver includes a ram, a cylinder and a piston, said piston being coupled with said ram, said cylinder being adapted to be coupled with a source of compressible fluid, and said cylinder having an intake port and an exhaust port and a valve for controlling the flow of said fluid to and from said cylinder, said method comprising:

(a) directing said fluid to said cylinder while said exhaust port is closed;

(b) continuing to direct said fluid to said cylinder while said piston moves through about two thirds of its stroke and then closing said intake and exhaust ports;

(c) maintaining said intake and exhaust ports closed while said fluid expands thereby moving said piston to one end of its stroke;

(d) exhausting said fluid from said cylinder thereby allowing said piston to move to the other end of its stroke;

(e) opening said intake port and closing said exhaust port; and (f) repeating steps (a) through (e).

* * * * *